US009115714B2

(12) United States Patent
Hattori et al.

(10) Patent No.: US 9,115,714 B2
(45) Date of Patent: Aug. 25, 2015

(54) SCREW COMPRESSOR HAVING LUBRICATING OIL SYSTEM

(75) Inventors: Toshirou Hattori, Tokyo (JP); Yusuke Ishizuki, Tokyo (JP)

(73) Assignee: MAYEKAWA MFG. CO., LTD. (JP)

( * ) Notice: Subject to any disclaimer, the term of this patent is extended or adjusted under 35 U.S.C. 154(b) by 214 days.

(21) Appl. No.: 13/090,730

(22) Filed: Apr. 20, 2011

(65) Prior Publication Data

US 2011/0256008 A1 Oct. 20, 2011

Related U.S. Application Data

(63) Continuation of application No. PCT/JP2008/069139, filed on Oct. 22, 2008.

(51) Int. Cl.
*F04B 17/00* (2006.01)
*F04B 35/04* (2006.01)
(Continued)

(52) U.S. Cl.
CPC ..... *F04C 18/16* (2013.01); *F04C 18/086* (2013.01); *F04C 2240/50* (2013.01); *F04C 2240/803* (2013.01); *F04C 2240/81* (2013.01); *F04C 2270/19* (2013.01)

(58) Field of Classification Search
CPC .... F16C 37/007; F16C 19/522; F16C 19/525; F16C 19/527; F04C 18/16; F04C 2240/50
USPC ..... 417/32, 3, 423.12, 423.13, 423.146, 417/423.14, 410.4, 410.5; 418/55.1, 55.6, 418/2; 184/6.16; 384/448
See application file for complete search history.

(56) References Cited

U.S. PATENT DOCUMENTS 3,329,766 A * 7/1967 Cole ..... 174/116
4,983,106 A 1/1991 Wright et al.
(Continued)

FOREIGN PATENT DOCUMENTS

JP 60-143184 U 9/1985
JP 61-104184 A 5/1986
(Continued)

OTHER PUBLICATIONS

International Search Report issued in corresponding PCT/JP2008/069139 dated Dec. 22, 2008.
(Continued)

*Primary Examiner* — Devon Kramer
*Assistant Examiner* — Amene Bayou
(74) *Attorney, Agent, or Firm* — Rossi, Kimms & McDowell LLP

(57) ABSTRACT

Providing a screw compressor 1 having a lubricating oil system, the compressor being provided with a plurality of radial bearings 5 and a plurality of thrust bearings 6, a rotor shaft 2*a* or 3*a* is supported rotation-freely by each bearing, wherein at least one radial bearing 5 or at least one thrust bearing is provided with a hole space 25 or 34 with a bottom, the hole space being bored in the radial bearing and the thrust bearing so that a temperature-detecting terminal 26 is inserted in the hole space 25 or 34; at least one penetrating hole 28 or 35 is provided at the casing wall 1*c* of a casing that houses the radial bearing 5, so that the outside of the casing communicates with a space s1 for inserting the radial bearing, through the penetrating hole, the space s1 28 or 35 being formed inside of the casing wall; the temperature-detecting terminal 26 together with a sheath tube 27 is led into the space s1 through the penetrating hole 28 or 35.

4 Claims, 8 Drawing Sheets

(51) Int. Cl.
*F04C 18/16* (2006.01)
*F04C 18/08* (2006.01)

(56) References Cited

U.S. PATENT DOCUMENTS

| | | | | |
|---|---|---|---|---|
| 5,392,716 | A * | 2/1995 | Orschek et al. | 105/61 |
| 5,399,027 | A * | 3/1995 | Ijuin et al. | 384/475 |
| 6,050,727 | A * | 4/2000 | Messmer et al. | 384/99 |
| 6,161,962 | A * | 12/2000 | French et al. | 384/459 |
| 6,312,226 | B1 * | 11/2001 | Senior et al. | 417/32 |
| 6,851,862 | B2 * | 2/2005 | Gozdawa | 384/121 |
| 7,116,095 | B2 * | 10/2006 | Takizawa et al. | 324/174 |
| 7,140,779 | B2 * | 11/2006 | Yoshimura et al. | 384/306 |
| 7,241,053 | B2 * | 7/2007 | Sato et al. | 384/448 |
| 7,347,301 | B2 * | 3/2008 | Sekiya et al. | 184/6.16 |
| 7,682,084 | B2 * | 3/2010 | Yoshimura et al. | 384/306 |
| 7,690,482 | B2 * | 4/2010 | Shoulders | 184/6.16 |
| 2003/0165181 | A1 * | 9/2003 | Gul | 374/185 |
| 2005/0013521 | A1 * | 1/2005 | Yoshimura et al. | 384/624 |
| 2006/0165335 | A1 | 7/2006 | Yoshimura et al. | |

FOREIGN PATENT DOCUMENTS

| | | | |
|---|---|---|---|
| JP | 63-63590 | U | 4/1988 |
| JP | 63-76913 | A | 4/1988 |
| JP | 2-149791 | A | 6/1990 |
| JP | 3-163214 | A | 7/1991 |
| JP | 11-247787 | A | 9/1999 |
| JP | 2004-100729 | A | 4/2004 |
| JP | 2005-054983 | A | 3/2005 |
| JP | 2005-54983 | A | 3/2005 |
| JP | 2006-112602 | A | 4/2006 |

OTHER PUBLICATIONS

Japanese Office Action for corresponding JP 2010-534628, mail date Feb. 26, 2013. Translation provided.

* cited by examiner cross section A-A view on arrow B

SCREW COMPRESSOR HAVING LUBRICATING OIL SYSTEM

This is a continuation of International Application PCT/JP2008/069139 (published as WO 2010/046976 A1) having an international filing date of 22 Oct. 2008. The disclosures of the PCT application, in its entity, including the drawings, claims, and the specifications thereof, are incorporated herein by reference.

BACKGROUND OF THE INVENTION

1. Field of the Invention

The present invention relates to a screw compressor having a lubricating oil system provided with a bearing part in which at least one temperature sensing element (temperature sensor) is arranged so that the temperature in the vicinity of the inner periphery surface of the bearing part can be directly measured and the detected temperature signal can be transferred outward of the casing of the compressor.

2. Background of the Invention

A screw compressor houses a male/female pair of screw rotors in the compressor; the rotor shaft is provided at each end (coupling side end or counter-coupling side end) regarding the male rotor or the female rotor; a radial bearing supports each rotor shaft. Further, a thrust bearing that receives the thrust force from each rotor is provided at the rotor shaft of the coupling side end or the counter coupling side end regarding each rotor. An example of this thrust bearing is a tilting pad bearing (a thrust bearing provided with tilting pads).

The rotor shaft at which the thrust bearing is arranged is provided with a thrust member 31 that is configured with a sleeve and a disc; thereby, the disc protrudes from the sleeve in the radial direction, and the inner periphery of the sleeve is fixed to the outer periphery of the rotor shaft, the inner periphery of the sleeve surrounding the outer periphery of the rotor shaft. On both the coupling side and the counter coupling side of the disc, a pads-retaining member is provided. The tilting pads are arranged on the coupling side and the counter coupling side of the disc, between the disc and the pads-retaining member on the coupling side as well as between the disc and the pads-retaining member on the counter coupling side; each tilting pad is fitted to the pads-retaining member on the coupling side or the counter coupling side so that the tilting pad can tilt against the radial direction as well as the hoop direction with regard to the rotor shaft on which the thrust member is fixed; each side of the disc of the thrust member slides on and comes in contact with the bearing surfaces of the tilting pads, while the thrust force is transferred to the thrust member (the disc) from the screw rotor.

In the screw compressor, since the rotors run at high speed, for instance, the radial bearing of a plain bearing type and the thrust bearing of a plain bearing type are used.

Heat is generated at the bearing surface (i.e. the radial bearing and the thrust bearing) of the bearing that supports the rotor; lube oil is usually supplied to the bearing surface so that a lube oil film is formed on the bearing surface and the generated heat is removed by the lube oil in the oil film. Thus, the temperature of each bearing is controlled so that the temperature does not exceed a certain level. Further, in a case where the lube oil film becomes out of order (e.g. oil film breakage) or the rotor comes in contact directly with the bearing surface, the bearing temperature abruptly increases and the components in the bearing are damaged. Hence, monitoring the bearing temperature is necessary so as to prevent the bearing temperature from reaching an abnormally high level.

In American Petroleum Institute Standard (API619/3$^{rd}$ edition) that includes rotary-type positive-displacement compressor, it is required that the temperature of the radial bearing and the thrust bearing in a screw compressor having a lubricating oil system be directly measured and controlled.

In a case where the radial bearing or the thrust bearing is of an oilless bearing type and the pressure level around the bearing is a level of the atmospheric pressure, it is not so difficult to arrange a temperature sensor at the bearing.

On the contrary, in a case where the bearing is of a lubricating oil system and the bearing is exposed to a high pressure equal to or higher than the discharging pressure level regarding the compressor, it is conventionally difficult to arrange a temperature sensor at the bearing. Hence, in conventional technologies, the temperature sensing part of the sensor is placed at the outer periphery surface of the bearing so as to measure the temperature thereof; then, the measured temperature is different from the temperature near to the oil film. Thus, it is unreasonable to say that the measured temperature is regarded as the true and accurate temperature of the bearing.

Even in a case where the sensing part of the temperature sensor is fitted to the bearing of the screw compressor having lubricating oil system, the measured temperature may be not accurate according to the fitting arrangement approaches of the sensor. Moreover, there are many problems to be solved in retrieving the temperature signals detected by the sensor from the outside of the compressor, or in maintaining the installed temperature-detecting element (or terminal). In addition, since the temperature level in the neighborhood of the bearing reaches 100° C. or higher, there may be another problem to be solved in retrieving the temperature signals detected by the sensor, or in providing durability regarding the lead-wire connected to the temperature-detecting element or terminal.

Patent Reference 1 (JP2006-112602) discloses a screw compressor provided with a resin layer that covers the bearing surface that supports the rotor shaft; thus, the temperature of the radial bearing or the thrust bearing can be measured. In the disclosed configuration, a hole (or a hole space with a bottom) is drilled on the bearing surface that supports the rotor shaft so that the hole space has an opening on the bearing surface as well as has a bottom in the bearing material; thus, the temperature sensing end-part of the sensor is inserted into and fixed in the hole space having the bottom; and, the gap space (or a clearance space) around the temperature sensing end-part of the sensor in the hole space is filled with a metal material for measuring temperature, the metal material being made from low melting white metal. Further, heat insulation material is provided so as to surround the filled metal material for measuring temperature.

REFERENCES

Patent References

Patent Reference 1: JP2006-112602

SUMMARY OF THE INVENTION

Subjects to be Solved

In the description of Patent Reference 1, however, it is not concretely disclosed how to route the lead wire so as to retrieve the temperature signals detected at the temperature sensing end-part (a temperature detecting terminal), out of the casing. In a case of providing passages for passing the lead wire in the casing or the bearing elements, it becomes necessary to bore not a few holes in the casing or the bearing elements; in addition, the strength of the casing or the bearing elements may be possibly spoiled due to the machined holes. Further, it is sometimes difficult to even find appropriate locations for the holes to be bored in the components such as the casing or the bearing elements.

Further, according to Patent Reference 1, a hole space with a bottom is provided in the bearing elements so that the longitudinal direction of the hole space lies at right angles to the axis direction of the rotor shaft where the bearing is fitted whereby the temperature detecting terminal is inserted into and fixed in the hole space with the bottom; and, the hole space with the bottom has an opening toward the bearing surface on the bearing element whereby the outer periphery surface of the rotor shaft slides on and comes in contact with the bearing surface on the bearing side. Hence, there arises an apprehension that unbalanced (uneven) load distribution may appear on the bearing surface. Further, foreign substances or contaminants may possibly stay on the bearing surface in and around the opening of the hole space with bottom; namely, frictional resistance in the bearing may be increased and the outer periphery surface of the rotor shaft may be damaged.

In view of the difficulties in the conventional technology as described above, the present invention aims at providing a screw compressor having a lubrication system whereby the temperatures of the bearing areas in the compressor can be accurately measured, the temperature signals detected at the temperature-detecting terminals can be transferred outside of the casing, and the temperature sensors can be easily attached and detached, so that the temperature monitoring and controlling regarding the bearings can be easily performed and the maintenance practices in the service operation of the screw compressor can be improved.

Means to Solve the Subjects

In order to reach the goals of the present invention, this specification discloses a screw compressor having a lubricating oil system, the compressor being provided with a plurality of radial bearings and a plurality of thrust bearings, a rotor shaft is supported rotation-freely by each bearing, wherein

- at least one radial bearing or at least one thrust bearing is provided with a hole space with a bottom, the hole space being bored in the radial bearing and the thrust bearing so that a temperature-detecting terminal is inserted in the hole space;
- at least one penetrating hole is provided at the casing wall of a casing that houses the radial bearing, so that the outside of the casing communicates with a space for inserting the radial bearing through the penetrating hole, the space for inserting the radial bearing being formed inside of the casing wall;
- the temperature-detecting terminal together with a sheath tube is led into the space for inserting the radial bearing through the penetrating hole, the sheath tube sheathing the lead wire connecting the temperature-detecting terminal to at least one detected temperature output terminal outside of the casing.

In the screw compressor as described above, the temperature-detecting terminal together with the sheath tube is led to the space for inserting the radial bearing through the penetrating hole from the outside of the casing, whereby the sheath tube sheathes the lead wire connecting the temperature-detecting terminal to at least one detected temperature output terminal outside of the casing. Further, the temperature-detecting terminal (led in the space for inserting the radial bearing) is routed into and fixed in the hole space with the bottom. In this way, the temperature-detecting terminal is routed to the radial bearing as well as the thrust bearing. Thus, the temperatures of the radial bearing and the thrust bearing can be directly measured.

Inside of the casing of the screw compressor, the screw compressor is previously provided with the spaces (extra spaces) for arranging the radial bearings and the thrust bearings on and around the rotor shafts. In the present invention, the space for inserting the radial bearing is utilized; the penetrating hole is bored in the casing toward the space for inserting the radial bearing; and, the sheath tube is passed to the space for inserting the radial bearing through the penetrating hole. Thus, it becomes unnecessary to provide an extra machined-hole in the casing, except for the penetrating holes and the hole spaces with the bottom. In this way, the temperature-detecting terminal can be easily led to the bearing without extra bored hole. Therefore, manufacturing cost can be restrained without spoiling the strength of the casing or the bearing component.

Further, the sheath tube sheathes the lead wire connecting the temperature-detecting terminal to the detected temperature output terminal outside of the casing; and the temperature-detecting terminal together with the sheath tube is led to the inside of the casing; and, temperature-detecting terminal is inserted into an fixed in the hole space with the bottom, the hole space being provided in the radial bearing or the thrust bearing. Thus, the temperature-detecting terminal can be easily fitted to the bearing. Thus, the temperature signals detected at the temperature-detecting terminal can be retrieved from the outside of the casing; and, the temperature-detecting terminal can be easily attached to or detached from the bearing. Accordingly, the temperature monitoring as well as the temperature controlling regarding the bearing elements can be realized; the monitoring and controlling function during the screw compressor operation can be enhanced.

A preferable embodiment of the above-described disclosure is the screw compressor having a lubricating oil system, wherein

- the hole space with the bottom is arranged in the radial bearing along the axis direction of the rotor shaft, and the hole space with the bottom has an opening thereof toward the space for inserting the radial bearing;
- the temperature-detecting terminal together with the sheath tube is passed through the penetrating hole provided at the casing wall, into the space for inserting the radial bearing, so that the temperature-detecting terminal is inserted into and fixed in the hole space with the bottom;
- the detected temperature signals detected at the temperature-detecting terminal are transferred to the outside of the casing, via the lead wire in the sheath tube.

According to the above, the hole space with the bottom is arranged in the radial bearing along the axis direction of the rotor shaft, and the hole space with the bottom has an opening thereof toward the space for inserting the radial bearing; thus, the temperature-detecting terminal can be arranged in the vicinity of the bearing surface which the outer periphery surface of the rotor shaft slides on and comes in contact with. In this way, the temperature in a high temperature range of the vicinity of the bearing surface of the tilting pad can be measured.

Further, the hole space with the bottom is arranged in the direction along the rotor axis direction, and the hole space with the bottom has the opening toward the space for inserting the radial bearing; thus, the temperature-detecting terminal that is led to the space for inserting the radial bearing can be easily routed to the hole space with the bottom.

Further, the hole space with the bottom has an opening not toward the bearing surface on the bearing element whereby the outer periphery surface of the rotor shaft slides on and comes in contact with the bearing surface on the bearing side; thus, the partial wear on the bearing surface can be evaded, the partial wear being caused when the opening is directed to the bearing surface. Further, there can be no apprehension that foreign substances or contaminants stay on the bearing surface.

Another preferable embodiment is the screw compressor having a lubricating oil system, wherein the radial bearing is a tilting pad journal bearing having a plurality of tilting pads whereby the outer periphery of the rotor shaft supported by the journal bearing slides on and comes in contact with the bearing surfaces of the tilting pads;

the tilting pad is provided with the hole space with the bottom so that the hole space with the bottom is arranged in the direction along the rotor axis direction, and the hole space with the bottom has the opening toward the space for inserting the radial bearing;

the temperature-detecting terminal together with a sheath tube is passed through the penetrating hole provided at the casing wall, into the space for inserting the radial bearing, so that the temperature-detecting terminal is inserted into and fixed in the hole space with the bottom.

As described above, the radial bearing is a tilting pad journal bearing having a plurality of tilting pads whereby the outer periphery of the rotor shaft supported by the journal bearing slides on and comes in contact with the bearing surfaces of the tilting pads; and, the tilting pad is provided with the hole space with the bottom so that the hole space with the bottom is arranged in the direction along the rotor axis direction. Therefore, the temperature-detecting terminal that can be positioned in the radial bearing in the vicinity of the bearing surface which the outer periphery of the rotor shaft slides on and comes in contact with; thus, the temperature in a high temperature range in the vicinity of the bearing surface of the tilting pad can be measured.

Further, the hole space with the bottom has the opening toward the space for inserting the radial bearing; thus, the partial wear on the bearing surface can be evaded, the partial wear being caused when the opening is directed to the bearing surface. In addition, there can be no apprehension that foreign substances or contaminants stay on the bearing surface.

Another preferable embodiment is the screw compressor having a lubricating oil system, wherein a disc shaped fastening member is provided around the rotor shaft where the thrust bearing is fitted so that the disc shaped fastening member is fastened to the rotor shaft and protrudes in the radial direction from the outer periphery of the rotor shaft;

the thrust bearing a tilting pad thrust bearing having a plurality of tilting pads whereby both side surfaces of the disc shaped fastening member slides on and comes in contact with the bearing surfaces of the tilting pads;

the tilting pad is provided with the hole space with the bottom so that the hole space with the bottom is arranged in the radial direction parallel to the bearing surface of the tilting pad, and the hole space with the bottom has the opening toward a space for charging and discharging lube oil, the space being formed between the casing wall and the area where the thrust bearing is placed;

the temperature-detecting terminal together with a sheath tube is passed through the penetrating hole provided at the casing wall, into the space for inserting the radial bearing, so that the temperature-detecting terminal is inserted into and fixed in the hole space with the bottom;

According to the above, the tilting pad is provided with the hole space with the bottom so that the hole space with the bottom is arranged in the radial direction parallel to the bearing surface of the tilting pad whereby both side surfaces of the disc shaped fastening member slides on and comes in contact with the bearing surfaces of the tilting pads; thus, the temperature-detecting terminal can be positioned in the tilting pad in the vicinity of the bearing surface of the tilting pad. Accordingly, the temperature in a high temperature range in the vicinity of the bearing surface of the tilting pad can be measured.

The opening of the hole space with the bottom is not directed toward space for inserting the radial bearing; however, the opening is directed toward space for charging and discharging lube oil, the space being formed between the casing wall and the area where the thrust bearing is placed. Accordingly, the temperature-detecting terminal that is led to the space for inserting the radial bearing from the outside of the casing can be comparatively easily inserted into the hole space with a bottom.

Further, the hole space with the bottom has the opening toward the space for inserting the radial bearing; thus, the partial wear on the bearing surface can be evaded, the partial wear being caused when the opening is directed to the bearing surface. In addition, there can be no apprehension that foreign substances or contaminants stay on the bearing surface.

Another preferable embodiment is the screw compressor having a lubricating oil system, wherein a lube oil charging and discharging hole provided in the casing wall is used as an alternative for the penetrating hole to be bored in the casing wall, the lube oil charging and discharging hole being bored for charging lube oil into the inside of the casing as well as discharging lube oil from the inside of the casing;

the sheath tube is led inside of the casing through the lube oil charging and discharging hole.

In this way, it becomes unnecessary to provide the penetrating holes for leading the sheath tubes, and additional machining of the casing can be dispensed with. Thus, manufacturing cost can be further reduced.

Another preferable embodiment is the screw compressor having a lubricating oil system, wherein the sheath tube is flexible regarding bending deformation.

In this way, it becomes easy to lead the temperature-detecting terminal along the piping route (regarding the sheath tube) from the outside of the casing to the hole space with the bottom via the space for inserting the radial bearing so that the sheath tube follows the route.

EFFECTS OF THE INVENTION

In the screw compressor having the lubricating system according the disclosure thus far, the screw compressor having a lubricating oil system is provided with a plurality of radial bearings and a plurality of thrust bearings, a rotor shaft is supported rotation-freely by each bearing, wherein at least one radial bearing or at least one thrust bearing is provided with a hole space with a bottom, the hole space being bored in the radial bearing and the thrust bearing so that a temperature-detecting terminal is inserted in the hole space;

at least one penetrating hole is provided at the casing wall of a casing that houses the radial bearing, so that the outside of the casing communicates with a space for inserting the radial bearing through the penetrating hole;

the temperature-detecting terminal together with a sheath tube is led into the space for inserting the radial bearing through the penetrating hole, the sheath tube sheathing the lead wire connecting the temperature-detecting terminal to at least one detected temperature output terminal outside of the casing.

Accordingly, the temperature-detecting terminal can be inserted into and fixed in the hole space with the bottom; thus, the temperatures of the bearing in the vicinity of the bearing surface of the radial bearing and the thrust bearing can be directly measured whereby the rotating surface (the outer periphery surface or the disc side surface) of the rotor shaft slides on and comes in contact with the bearing surface.

Further, the sheath tube is led to the space for inserting the radial bearing; in this way, it becomes unnecessary to provide an extra machined-hole in the casing and the bearing, except for the penetrating hole and the hole space with the bottom. Therefore, manufacturing cost can be restrained without spoiling the strength of the casing or the bearing component.

Further, the temperature signals detected at the temperature-detecting terminal can be retrieved from the outside of the casing; and, the temperature-detecting terminal can be easily attached to and detached from the bearing. Accordingly, the temperature monitoring as well as the temperature controlling regarding the bearing elements can be realized; the monitoring and controlling function during the screw compressor operation can be enhanced.

According to the present invention, the temperature in the vicinity of the bearing surface that the rotor shaft slides on as well as comes in contact with can be directly measured; hence, the present invention can provide the method as well as the apparatus that is compatible with American Petroleum Institute Standard (API619) in relation to the bearing temperature measurement and control.

BRIEF DESCRIPTION OF THE DRAWINGS

The present invention will now be described in greater detail with reference to the preferred embodiments of the invention and the accompanying drawings, wherein:

FIG. 7(*b*) shows a side view of the radial bearing in the first embodiment;

FIG. 8(*b*) shows a plan view of the thrust bearing in the first embodiment;

FIG. 8(*c*) shows a right side view of the thrust bearing in the first embodiment;

FIG. 10(*b*) shows a left-half cross section (cross section A-A) and the right-half front view (view on arrow B) regarding the radial bearing in FIG. 10(*a*).

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

First Embodiment

Figure 1:
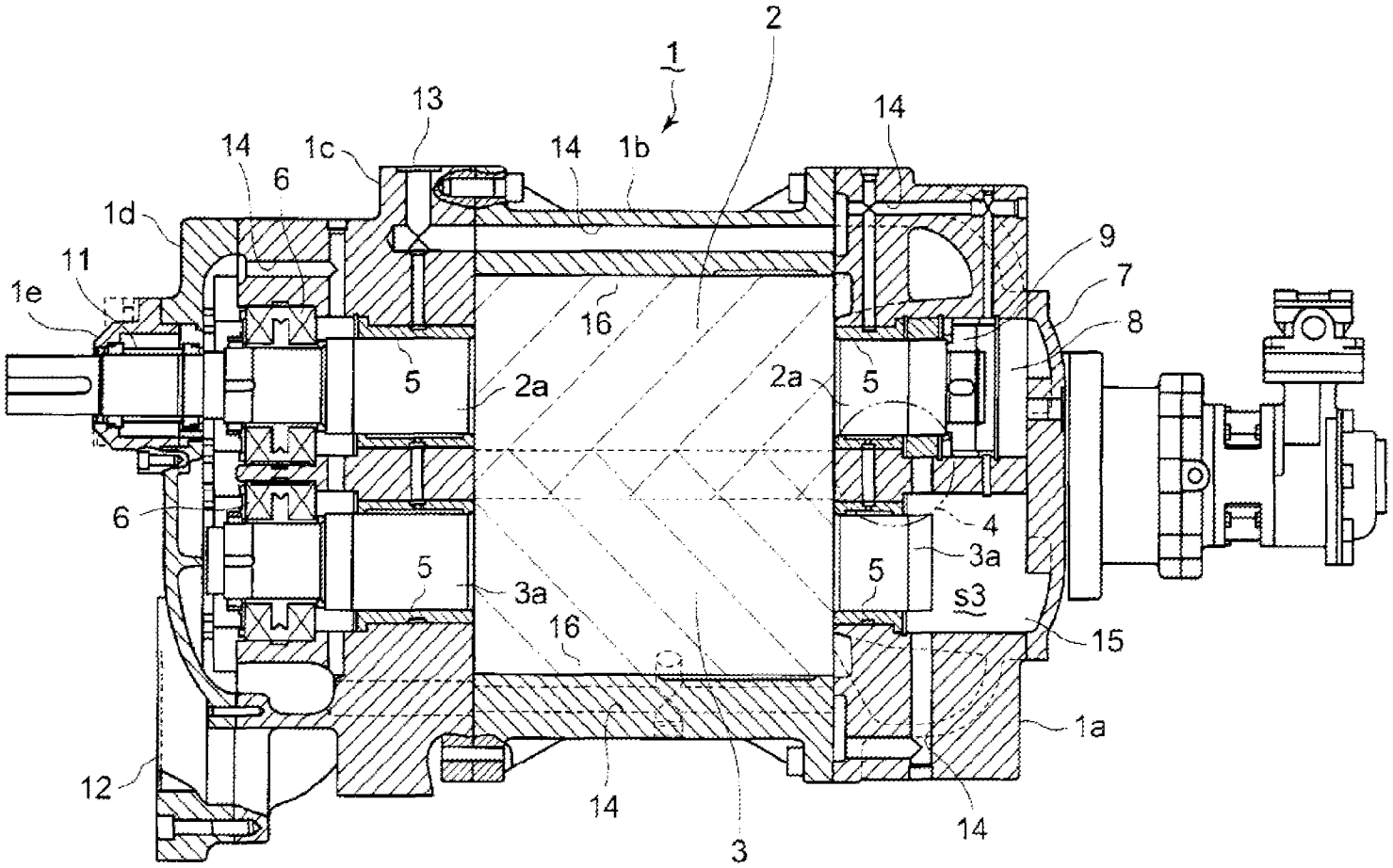
FIG. 1 shows a longitudinal section of a screw compressor having a lubricating oil system.

With reference to FIGS. 1 to 8(*c*), the first embodiment according to the present invention is now explained. FIG. 1 shows a longitudinal section of a screw compressor 1 having a lubricating oil system. In FIG. 1, the casing of the screw compressor 1 is configured with a plurality of divided parts: a gas charging side cover 1*a*, a rotor casing 1*b*, bearing head 1*c* and a bearing cover 1*d*; these divided parts are integrated into the casing by use of fasteners such as bolts. Inside of the rotor casing 1*b*, a male rotor 2 and a female rotor 3 are housed, both rotors being arranged in parallel to each other and engaged with each other. The gas charging side cover 1*a* is provided with a gas charging opening 4. A rotor shaft 2*a* is provided at the coupling side end and the counter coupling side end of the male rotor 2, each rotor shaft 2*a* being integrated with the male rotor 2; a rotor shaft 2*b* is provided at the coupling side end and the counter coupling side end of the female rotor 3, each rotor shaft 3*a* being integrated with the female rotor 3.

A driving device such as an electric motor (not shown) is connected to the gas discharging side end of the rotor shaft 2*a* so that the male rotor 2 rotates; and the female rotor 3 engaged with the male rotor 2 rotates in response to the rotation movement of the male rotor 2. The rotor shaft 2*a* on the gas discharging side as well as the gas charging side of the male rotor 2 is rotation-freely supported by a radial bearing 5; the rotor shaft 3*a* on the gas discharging side as well as the gas charging side of the female rotor 3 is rotation-freely supported by a radial bearing 5. The radial bearings 5 supporting the male rotor 2 bear the radial forces from the male rotor 2; the radial bearings 5 supporting the female rotor 3 bear the radial forces from the female rotor 3.

Further, a thrust bearing 6 is provided at the male rotor shaft 2*a* on the gas discharging side as well as at the female rotor shaft 3*a* on the gas discharging side. The thrust bearing 6 supporting the thrust forces from the male rotor 2 bears the thrust forces from the male rotor 2; the thrust bearing 6 supporting the female rotor 3 bears the thrust forces from the female rotor 3.

A cover 7 tightly closes the rotor shaft end side of the male rotor shaft 2*a* on the gas charging side so that a pressure chamber 8 is formed. Inside of the pressure chamber 8, a balance piston 9 is arranged. Further, outside of the thrust bearing 6 of the male rotor shaft 2*a*, a mechanical shaft seal 11 is provided so that a cover 1*e* tightly closes the periphery of the mechanical shaft seal 11.

Further, while the screw compressor having the lubricating oil system is operated, gas fluid is inhaled through the gas charging opening 4 so as to be compressed in the closed space formed by the male rotor 2 and the female rotor 3 that engage with each other; the compressed gas fluid is discharged through a discharging opening 12. An oil mist separator (not shown) removes the lube oil content contained in the gas fluid discharged from the discharging opening 12; the separated lube oil is returned back to a lube oil inlet 13. The lube oil including the returned-back oil supplied to the lube oil inlet 13 is pressurized by an oil pump (not shown) and supplied to various areas through oil passages 14 that are bored in the rotor casing. In addition, a part of lube oil sent to the pressure chamber 8.

A part of the lube oil reaches a chamber 15 provided at the rotor shaft end of the female rotor 3 on the gas charging side; the lube oil is sent to a rotor space (i.e. a rotor chamber) 16 from the chamber 15; after lubricating the rotors 2 and 3, the lube oil is discharged through the discharging opening 12 together with the gas fluid.

The pressure in the pressure chamber 8 is increased by means of the balance piston 9 and pushes the male rotor shaft 2*a* toward the gas discharging side; thus, the thrust force working on the male rotor 2 toward the gas charging side is reduced thanks to the enhanced pressure on the gas charging side over the pressure on the gas discharging side. The lube oil is supplied also to the radial bearings 5 and the thrust bearings 6 so as to evade the temperature increases or the seizure of the bearings.

Figure 5:
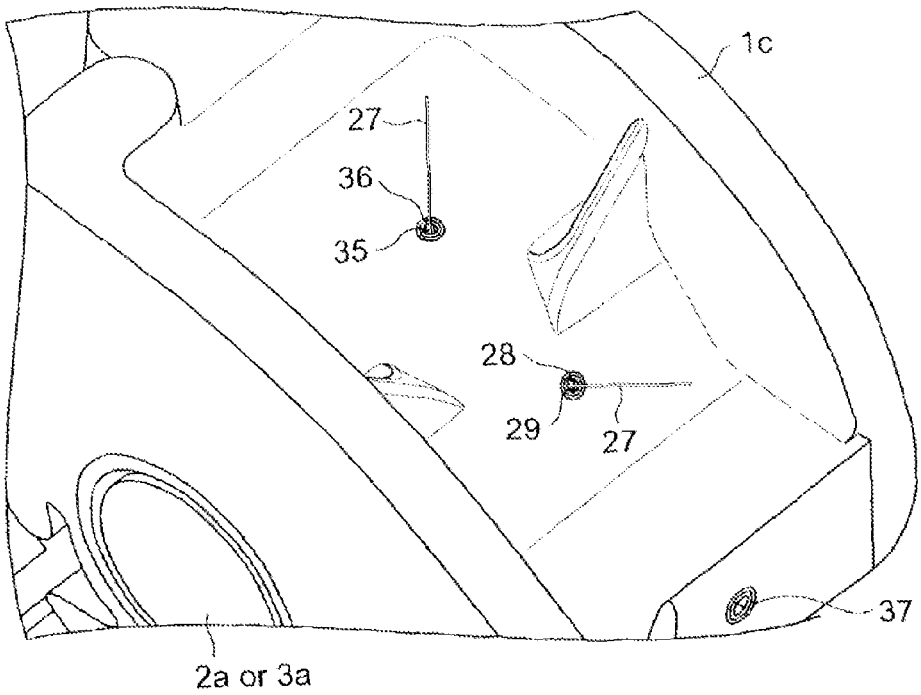
FIG. 5 shows a bird view of the casing of the screw compressor (having the lubricating oil system) according to the first embodiment, the casing being seen from the outside of the casing.
Figure 6:
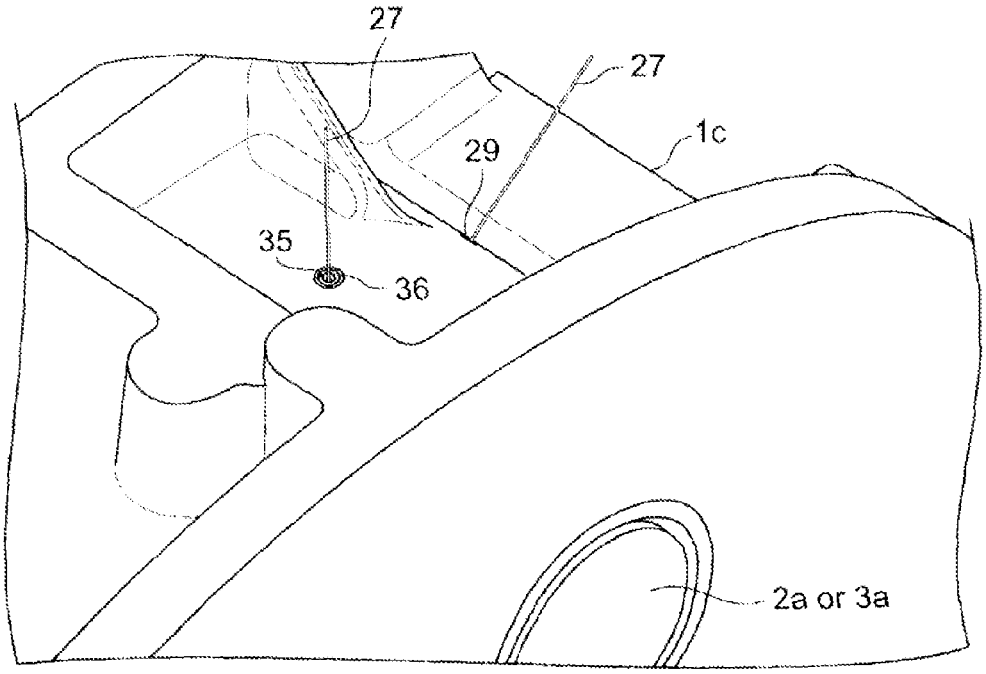
FIG. 6 shows a bird view of the casing of the screw compressor (having the lubricating oil system) according to the first embodiment, the casing being seen from a direction different from that of FIG. 2.
Figure 7A:
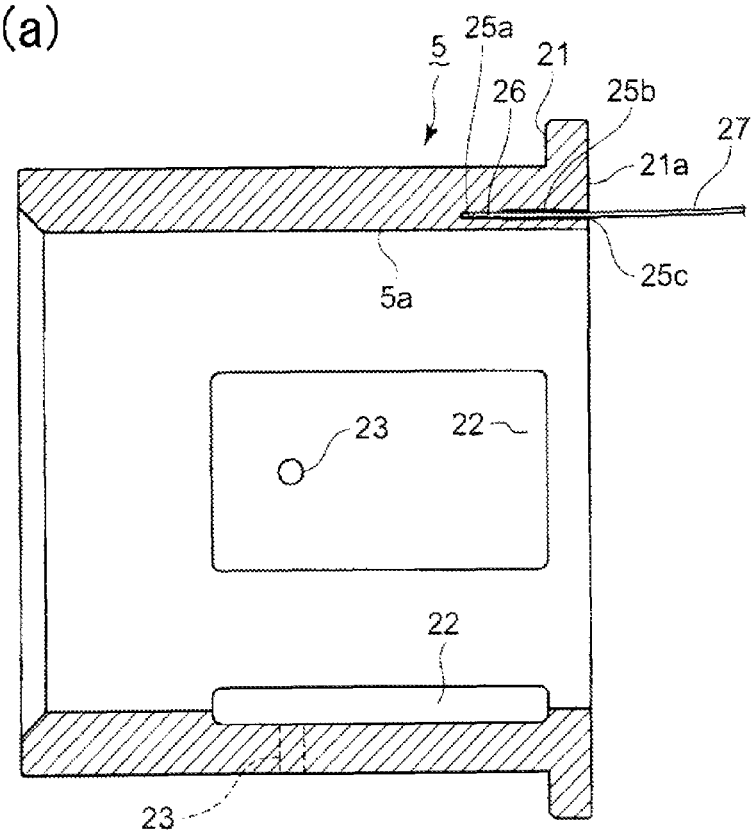
FIG. 7(*a*) shows a cross section of the radial bearing in the first embodiment.
Figure 7B:
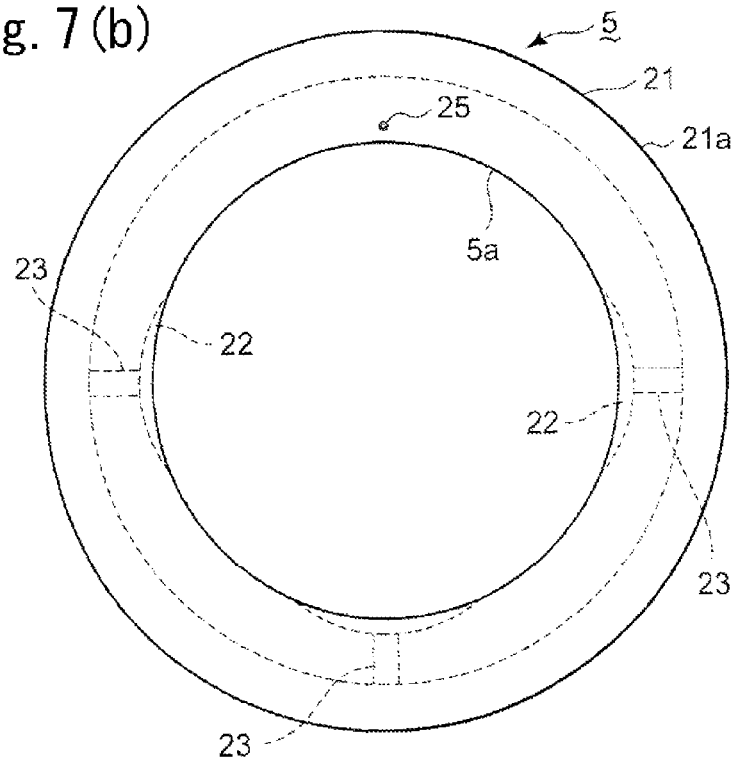

FIGS. 2 to 6 show how thermocouples for detecting temperatures are fitted to the radial bearings 5 and the thrust bearings 6, both the bearings being provided in the bearing head 1*c* on the gas discharging side. In the first place, the configuration of the thermocouple fitted to the radial bearing 5 is explained. Further, FIGS. 7(*a*) and 7(*b*) show an enlarged longitudinal section and an enlarged front view regarding the radial bearing 5. As shown in FIGS. 7(*a*) and 7(*b*), the radial bearing 5 forms a cylindrical shape; on the inner periphery surface 5*a* thereof, the outer periphery surface of the rotor shaft 2*a* or 3*a* slides, coming in contact with the inner periphery surface 5*a*. The radial bearing 5 is provided with a flange part 21 on the one end side in the longitudinal direction of the radial bearing 5. A plurality of recesses 22 for accumulating lube oil is provided on the inner periphery surface 5*a* of the radial bearing and a lube oil passage 23 is bored so as to supply lube oil into each recess from the outer periphery surface of the radial bearing 5.

Figure 2:
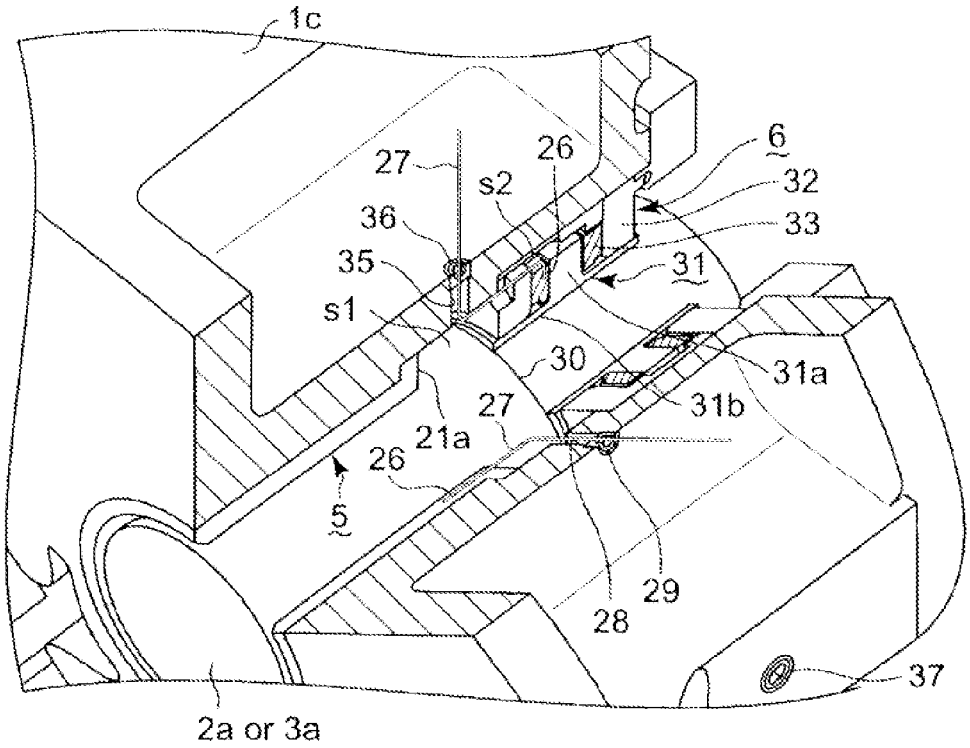
FIG. 2 shows a bird view of the bearing of the screw compressor (having the lubricating oil system) according to a first embodiment of the present invention, a part of the bearing being cut.
Figure 3:
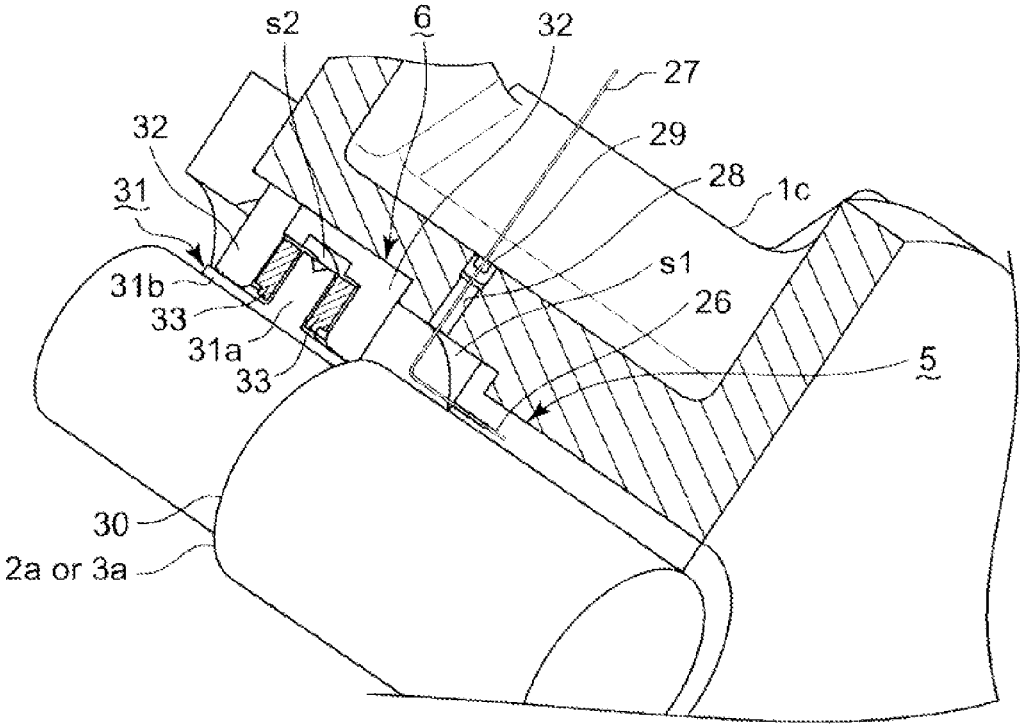
FIG. 3 shows a bird view of the bearing of the screw compressor (having the lubricating oil system) according to the first embodiment, the bearing being seen from a direction different from that of FIG. 2.
Figure 4:
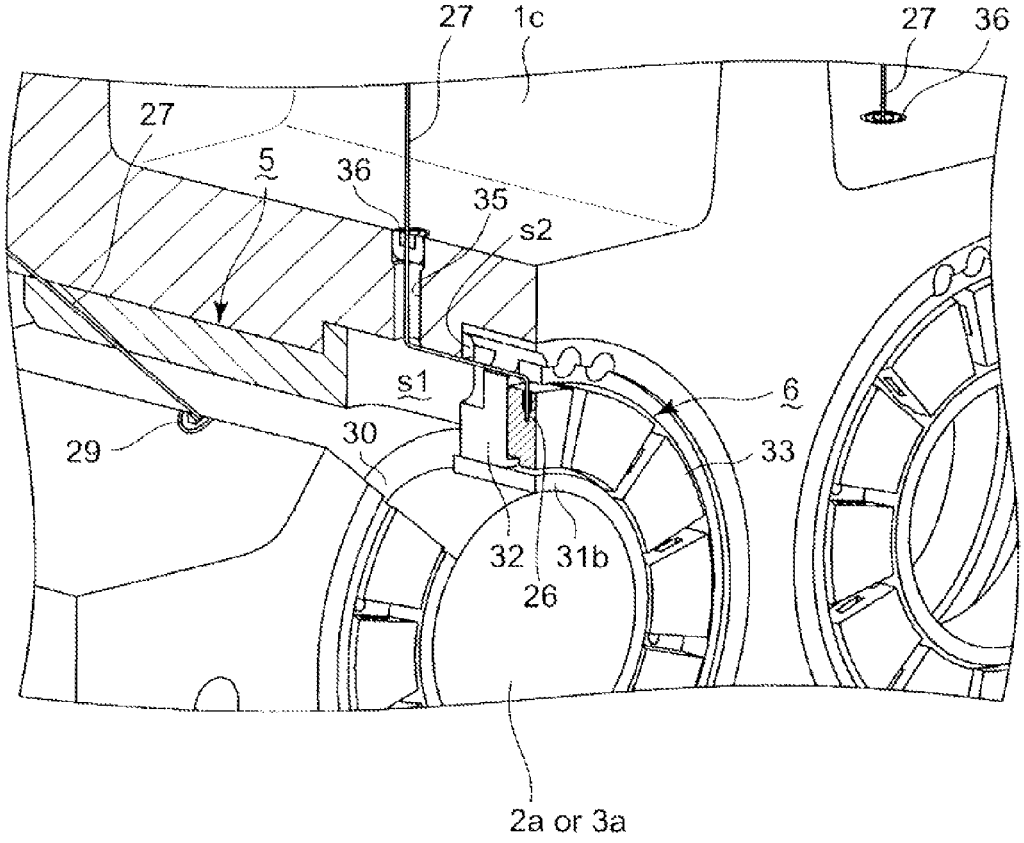
FIG. 4 shows a bird view of the bearing of the screw compressor (having the lubricating oil system) according to the first embodiment, the bearing being seen from another direction different from that of FIG. 2.

As shown in FIGS. 2 to 4, when the radial bearing 5 is inserted around the rotor shaft 2*a* or 3*a*, the radial bearing 5 is arranged so that an end surface 21*a* (an outer end surface 21*a*) of the flange 21 faces to a space s1 for inserting the radial bearing 5. On the outer end surface 21*a*, a hole space 25 with the bottom thereof is bored so that a thermocouple is inserted into and fixed in the hole space 25. The hole space 25 has a small diameter (e.g. 1 mm diameter) so that the temperature-detecting terminal 26 of the thermocouple can be inserted through the hole space 25, while the hole space 25 has an opening on the outer end surface 21*a* of the flange 21. Further, the hole space is bored in the neighborhood of the inner periphery surface 5*a* along the longitudinal direction (i.e. the rotor axis direction) of the radial bearing 5.

The hole space 25 with the bottom includes

- a space 25*a* for placing and fixing the temperature-detecting terminal, the space 25*a* being located at the bottom part of the hole space 25 and having a small diameter; and,
- a hole body space 25*b* locating toward the front of the space 25*a* and having a relatively larger diameter in comparison with the diameter of the space 25*a*. A sheath tube 27 (for guiding the sensor wire) is provided so that an end part of the sheath tube is fitted in the hole body space 25.

Although the sheath tube 27 is covered with stainless steel, the pipe 27 is flexible. Outside of the hole space 25 with the bottom, the space s1 for inserting the radial bearing is formed; a penetrating hole 28 is provided in the wall part of the bearing head 1*c*; the wall surface (the inner side surface) of the bearing head faces to the space s1.

The processes of fitting the temperature-detecting terminal 26 and the sheath tube 27 to the radial bearing 5 are now explained as follows. At first, the radial bearing 5 is mounted on the rotor shaft 2*a* or the rotor shaft 3*a*; then, the temperature-detecting terminal 26 and the sheath tube 27 are inserted into a compression fitting 29 (provided in the penetrating hole 28). After being passed through the compression fitting 29 and the penetrating hole 28, the temperature-detecting terminal 26 and the sheath tube 27 are forwarded into the space inside of the casing wall of the bearing head 1*c*. Then, the temperature-detecting terminal 26 is brought to the opening 25*c* of the hole space 25 with the bottom; further, the temperature-detecting terminal 26 is inserted into and fitted in the hole space 25. Then, the compression fitting 29 is caulked (or squeezed) at the opening on the outer side of the penetrating hole 28 so that the compression fitting is fixed. FIG. 5 as well as FIG. 6 shows a view of the arrangement regarding the sheath tube 27 from the outer side of the bearing head 1*c*.

Incidentally, in a case where the position of the penetrating hole 28 is different from that of the opening 25*c* of the hole space 25 with regard to the hoop direction around the rotor axis, the temperature-detecting terminal 26 is once directed along the hoop direction, so that the sheath tube is bent and a part of the sheath tube is put along the hoop direction. Then, the temperature-detecting terminal 26 is brought to the opening 25*c* of the hole space 25 with the bottom; further, the temperature-detecting terminal 26 is inserted into and fitted in the hole space 25. Since the sheath tube in this embodiment is flexible, the lead wire arrangement can be easily performed in response to the wire routes.

In the next place, the configuration of the thermocouple fitted to the thrust bearing 6 is explained. As shown in FIGS. 2 to 4, the thrust bearing 6 is fitted around the rotor shaft at which the diameter thereof is smaller than diameter of the rotor shaft where the radial bearing 5 is mounted; a step 30 (cf. FIG. 4) is provided between the smaller diameter part and the larger diameter part regarding the rotor shaft; the smaller diameter part and the larger diameter part are integrated with each other, and form the rotor shaft 2*a* or 3*a*. The rotor shaft (the smaller diameter part) at which the thrust bearing is arranged is provided with a thrust member 31 that is configured with a sleeve 31*b* and a disc 31*a*; thereby, the disc protrudes from the sleeve in the radial direction, and the inner periphery of the sleeve surrounds and is fitted to the outer periphery of the smaller diameter part regarding the rotor shaft 2*a* or 3*a*.

The thrust member 31 are positioned so that the side face of the sleeve 31*b* on the rotor side comes in contact with the step 30; and the position is fixed to the rotor shaft 2*a* or 3*a*. In this way, the movement of the thrust member 31 in the rotor axis direction or the rotor hoop direction is prevented. Accordingly, the thrust member 31 can be surely fixed.

The thrust bearing 6 includes, but not limited to, the thrust member 31;

a pads-retaining member 32 provided at each of the gas discharging side and the gas charging side of the disc 31*a*; and, a plurality of tilting pads 33 provided at each of the gas discharging side and the gas charging side of the disc 31*a*, the tilting pads being spaced uniformly in the hoop direction.

The tilting pads 33 are loosely fitted to the pads-retaining member 32 with clearance (i.e. play) by bolts (not shown), so that each tilting pad can tilt in the rotor hoop direction as well as the rotor radial direction. While the rotor shaft 2*a* or 3*a* rotates, the side surface of the disc 31*a* slides on and comes in contact with the bearing surfaces of the tilting pads so that the tilting pads bear the thrust force in the thrust direction.

Figure 8A:
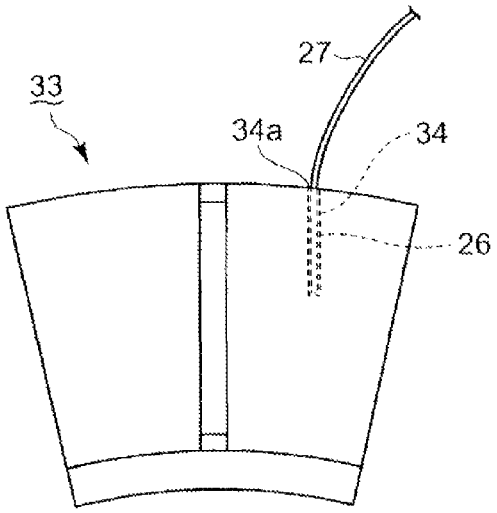
FIG. 8(*a*) shows a front view of the thrust bearing in the first embodiment.
Figure 8B:
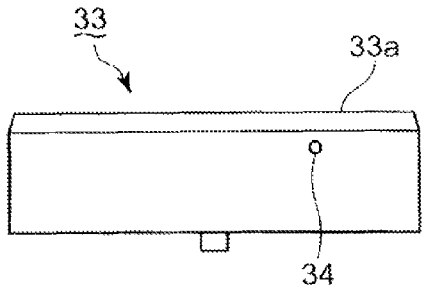
Figure 8C:
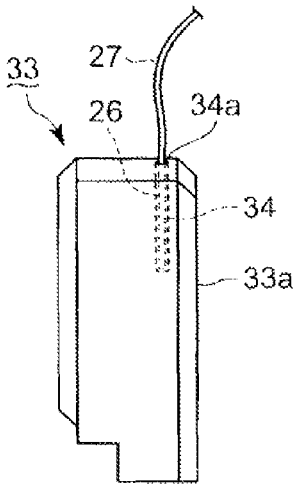
Figure 9A:
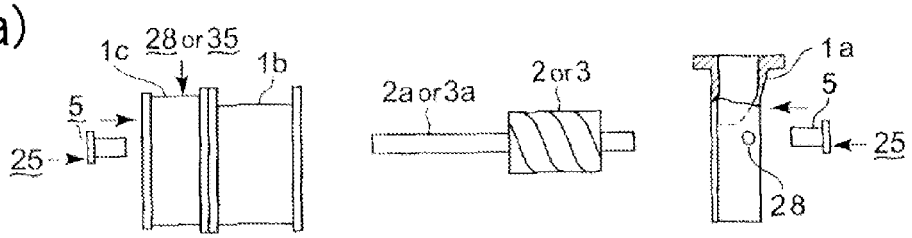
FIGS. 9(*a*) to 9(*d*) explain the assembling processes of the screw compressor (having the lubricating oil system) according to the first embodiment.
Figure 9B:
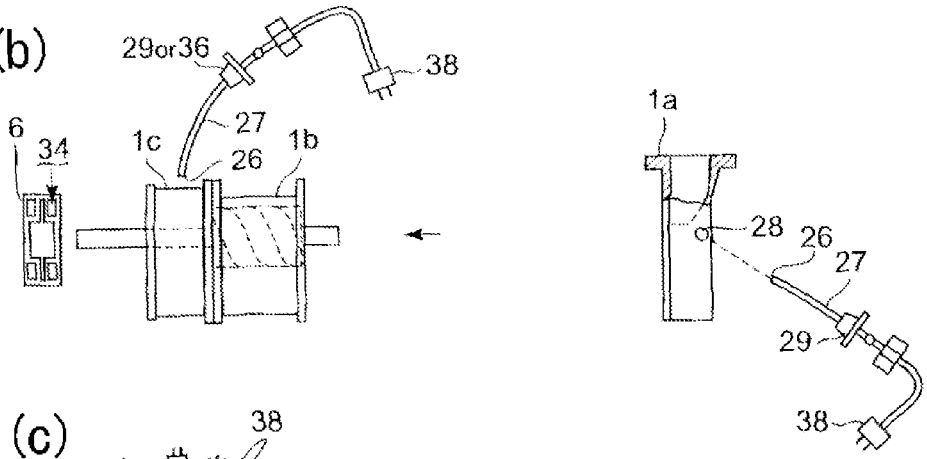
Figure 9C:
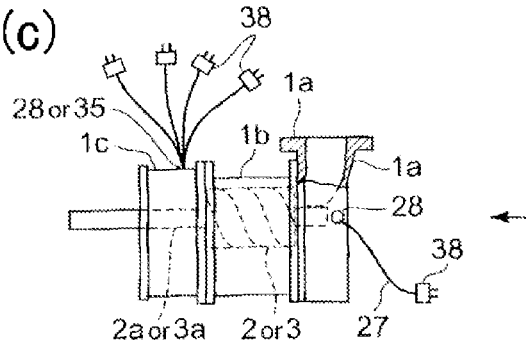
Figure 9D:
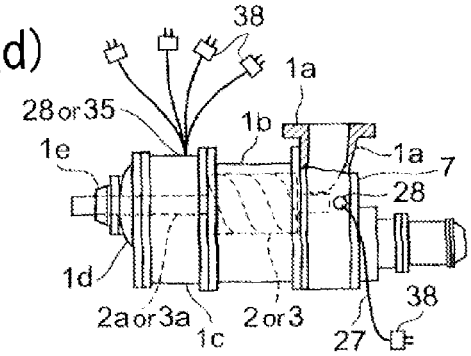

In FIGS. 8(*a*) to 8(*c*), the tilting pad 33 is depicted. As shown in FIGS. 8(*a*) to 8(*c*), the tilting pad forms a thick plate sector shape. In the tilting pad as well as in the neighborhood of the bearing surface 33*a* of the tilting pad 33 which the thrust force transfer side face of the disc 31*a* slides on and comes in contact with, a hole space 34 with the bottom thereof is bored so that the hole space 34 is arranged parallel to the bearing surface 33*a* in the radial direction. The depth of the hole space 34 is, for instance, approximately 10 to 20 mm. The longitudinal direction of the hole space 34 is arranged so that the longitudinal axis is directed just along the radial direction perpendicular to the axis of the rotor shaft 2*a* or 3*a* as well as along the radial direction of the thrust bearing 6, when the tilting pad 33 is fitted to the pads-retaining member 32. In addition, the opening 34*a* of the hole space 34 with the bottom faces to a space s2 for charging lube oil to the thrust bearing 6 and discharging lube oil from the thrust bearing 6, the space s2 being formed on the inner periphery surface of the pads-retaining member that surrounds the outer periphery of the disc 31*a* of the thrust member 31.

In the example of FIG. 2 as well as FIG. 4, a penetrating hole 35 that penetrates the bearing head 1*c* is provided so that the penetrating hole 35 reaches the space s1 for inserting the radial bearing; thereby, the radius level of the position regarding the space s1 corresponds to the radius level of the position regarding the opening 34*a* of the hole space 34 with a bottom.

The processes of fitting the temperature-detecting terminal 26 and the sheath tube 27 to the thrust bearing 6 are now explained as follows. At first, the thrust bearing 6 fitted to the rotor shaft 2*a* or 3*a* of the screw compressor 1 having the lubricating system is dismantled, and tilting pads 33 are removed from the thrust bearing 6 (or the pads-retaining member 32).

Then, the temperature-detecting terminal 26 and the sheath tube 27 are inserted into a compression fitting 36 (provided in the penetrating hole 35). After being passed through the compression fitting 36 and the penetrating hole 35, the temperature-detecting terminal 26 and the sheath tube 27 are forwarded into the space inside of the casing wall (of the bearing head 1*c*). Then, the temperature-detecting terminal 26 is further forwarded through the thrust bearing 6 from which the tilting pads 33 have been removed; and, the temperature-detecting terminal 26 is inserted into and fixed in the hole space 34 with the bottom, the hole space 34 being provided in the tilting pad 33.

For the next step, the tilting pad 33 to which the temperature-detecting terminal 26 is fixed is attached to the thrust bearing 6; and, the thrust bearing 6 is assembled (as a bearing unit), and is mounted into the screw compressor 1; then, the compression fitting 36 is caulked (or squeezed) at the opening on the outer side of the penetrating hole 35 so that the compression fitting is fixed.

In addition, a sheath type thermocouple is preferably used; hereby, the sheath type thermocouple is a thermocouple that has a metal sheath tube for protecting the thermocouple wire therein, the metal sheath tube being filled with insulating powder of inorganic material such as magnesium oxide or silica. The sheath type thermocouple offers excellent insulation properties, sealing properties (gas-tightness) and response performance; further, the sheath type thermocouple can be remarkably durable so as to be used in adverse environments such as a high temperature condition, for an extended period of use.

According to this embodiment, the hole space 25 with the bottom is provided in the close neighborhood of the inner periphery of the radial bearing 5 in which the rotor shaft 2*a* or 3*a* rotates so as to slide on and come in contact with the inner periphery; the temperature-detecting terminal 26 is inserted into and fixed in the hole space 25 with the bottom. Thus, the temperature in the vicinity of the inner periphery of the radial bearing 5 can be measured with high accuracy.

Further, the hole space 25 with the bottom has the opening 25*c* toward the space s1 for inserting the radial bearing; the temperature-detecting terminal 26 together with the sheath tube 27 is passed into the space s1 for inserting the radial bearing, from the outside of the casing, through the penetrating hole 28; the temperature-detecting terminal 26 together with the sheath tube 27 is inserted into and fixed in the hole space 25 with the bottom. Thus, the temperature-detecting terminal 26 and the sheath tube 27 can be easily fitted to the radial bearing in the screw compressor.

In other words, the space s1 for inserting the radial bearing 5 into the screw compressor is utilized as a pathway through which the temperature-detecting terminal 26 and the sheath tube 27 are laid. Therefore, the machining for providing holes (or hole spaces) other than the penetrating holes 28 and the hole spaces 25 with the bottom can be dispensed with. Thus, the labor hour regarding the machining can be restrained to a minimum level. Further, the strength of the casing (including the bearing head) or the bearing member can be prevented from being spoiled. In addition, the manufacturing cost can be restrained.

Further, the opening 25*c* of the hole space 25 (with the bottom) regarding the radial bearing 5 is not directed toward the bearing surface (the clearance space) between the radial bearing and the rotor shaft 2*a* or 3*a*; thus, the partial wear on the bearing surface can be evaded. Further, there can be no apprehension that foreign substances or contaminants stay on the bearing surface.

Also in the thrust bearing 6, the temperature-detecting terminal 26 of the thermocouple is positioned in the close neighborhood of the bearing surface (the sliding/contacting surface 33*a*) of the tilting pad 33 that faces the disc 31*a*; accordingly, the temperature in the vicinity of the bearing surface 33*a* of the tilting pad 33 can be detected with high accuracy and sensitivity.

Further, the hole space 34 with the bottom has the opening toward the space s2 for charging and discharging lube oil, the space s2 being formed between the casing wall (of the rotor casing or the bearing head) and the thrust bearing 6; and, the temperature-detecting terminal 26 and the sheath tube 27 led to the hole space 34 with the bottom bored in the tilting pad 33, from the outside of the bearing head 1*c*, through the space s1 for inserting the radial bearing (into the screw compressor) and the space s2 for charging and discharging lube oil (to and from the thrust bearing). Therefore, the temperature-detecting terminal 26 and the sheath tube 27 can be easily arranged. In addition, the hole machining regarding the casing of the screw compressor can be restrained to a minimum level; and, the manufacturing cost can be restrained.

Further, the opening of the hole space 34 (with the bottom) bored in the tilting pad 33 is not directed toward the bearing surface (or toward the clearance space between the tilting pad 33 and the disc 31*a*); thus, the partial wear on the bearing surface can be evaded. Further, there can be no apprehension that foreign substances or contaminants stay on the bearing surface.

Further, since the sheath tube 27 is of a flexible type, the lead wire arrangement from the outside of the bearing head 1*c* to the radial bearing 5 or the thrust bearing 6 can be easily performed.

In addition, in a case where lube oil charging holes or lube oil discharging holes are provided in the rotor casing (or the bearing head) so that the lube oil charging holes or the lube oil discharging holes are placed close to the hole space 25 or the hole space 34 via the space s1 or the space s2, the sheath tube 27 may be passed through the lube oil charging holes or the lube oil discharging holes. In this case, since the sheath tube 27 can be pulled out of the casing of the compressor, it becomes unnecessary to provide the penetrating holes 28 and 35.

As shown in FIG. 2 or 5, for instance, in a case where a lube oil charging and discharging pipe 37 for charging and discharging lube oil is provided at the bearing head 1*c*, the sheath tube 27 may be laid through the pipe 37 without providing the penetrating hole 28.

As described above, the machining process for boring a hole in the bearing head can be dispensed with; thus, retrieving the detected temperature signals can be easily performed at a low cost.

In the embodiment as described, the thermocouple for detecting temperature is fitted to the radial bearing 5 and the thrust bearing 6 at the rotor shaft on the gas discharging side of the compressor. The thermocouple may be fitted to the radial bearing 5 and the thrust bearing 6 at the rotor shaft on the gas charging side of the compressor, except for the rotor shaft to which the balance piston 9 is fitted. In FIG. 1, For instance, in FIG. 1, the thermocouple for detecting temperature can be provided at the radial bearing 5 for the rotor shaft 3*a* of the female rotor 3 on the gas charging side, inside of the gas charging side cover 1*a*.

In the above-described case, the end surface 21*a* of the flange 21 regarding the radial bearing 5 faces to a space s3 in the chamber 15; thus, the opening 25*c* of the hole space 25 with the bottom may be directed toward the space s3; and, the temperature-detecting terminal 26 can be inserted into and fixed in the hole space 25 with the bottom. Further, the temperature-detecting terminal 26 together with the sheath tube 27 can be led into the space s3.

In addition, a penetrating hole may be provided at a partition wall in the gas charging side cover 1*a*; and, through the provided penetrating hole, the sheath tube 27 led into the space s3 (from the hole space 25 with the bottom) may be pulled out of the gas charging side cover 1*a*.

In this way, as is the case with the above-described embodiment, the temperature of the radial bearing 5 can be measured with accuracy; further, the hole machining regarding the gas charging side cover 1*a* can be restrained to a minimum level. In addition, the temperature-detecting terminal 26 and the sheath tube 27 can be easily arranged; and, retrieving the detected temperature signals toward the outside of the compressor can be easily performed.

FIGS. 9(*a*) to 9(*d*) explain the arranging processes for simultaneously fitting the temperature-detecting terminals 26 and the sheath tubes 27 to all the radial bearings 5 and the thrust bearings 6 except for the radial bearing for the rotor shaft to which the balance piston 9 is fitted on the gas charging side of the compressor. Firstly, FIG. 9(*a*) shows the process stage where the bearing head 1*c* is integrated into one body with the rotor casing 1*b* by use of the fastening bolts before the rotor 2, the rotor 3 and the gas charging side cover 1*a* are mounted into the integrated one body made from the rotor casing 1*b* and the bearing head 1*c*. In this stage, one penetrating hole 28 is already bored in the gas charging side cover 1*a*; further, two penetrating holes 28 and two penetrating holes 35 (four holes in total) are already bored in the bearing head 1*c*. Then, the radial bearings having the hole space with the bottom are mounted inside of the gas charging side cover 1*a* and the bearing head 1*c*.

Secondly, as shown in FIG. 9(*b*), after the temperature-detecting terminals 26 and the sheath tubes 27 are passed through the compression fitting 29 and the penetrating hole 28, the temperature-detecting terminals 26 and the sheath tubes 27 are led to the inside of the gas charging side cover 1*a* and the bearing head 1*c* so as to be fitted to the radial bearing 5. Then, the rotor 2 or 3 is mounted into the rotor casing 1*b* and the bearing head 1*c*.

In a similar way, with regard to the thrust bearing, after the temperature-detecting terminals 26 and the sheath tubes 27 are passed through the compression fitting 29 or 36 as well as the penetrating hole 28 or 35, the temperature-detecting terminals 26 and the sheath tubes 27 are led to the inside of the bearing head 1*c* so as to be fitted to the tilting pad 33 of the thrust bearing 6. Then, the thrust bearing 6 is mounted on the rotor shaft 2*a* or 3*a*. Incidentally, at the front side end of the sheath tube 27, a temperature output terminal 38 to be connected to a detected signal processing-device (not shown) by use of a connecting element such as a screw-in connector.

As shown in FIG. 9(*c*) next to FIG. 9(*b*), the gas charging side cover 1*a* is coupled to the rotor casing 1*b*. Then, as shown in FIG. 9(*d*), the bearing cover 1*d*, a cover 1*e*, a cover 7 and other necessary components are mounted, and the assembly processes are finished.

Second Embodiment

Figure 10A:
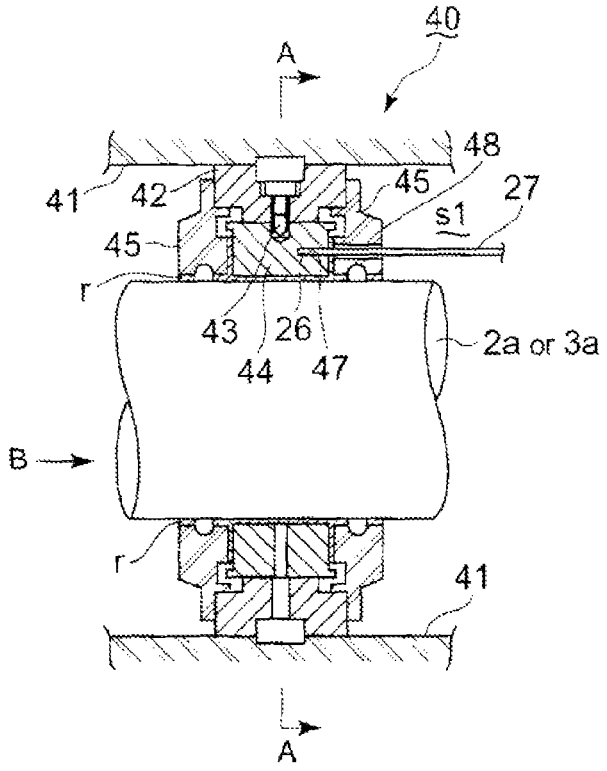
FIG. 10(*a*) shows a longitudinal section of a radial bearing and the side view of the rotor in a second embodiment of the screw compressor (having the lubricating oil system) according to the present invention.
Figure 10B:
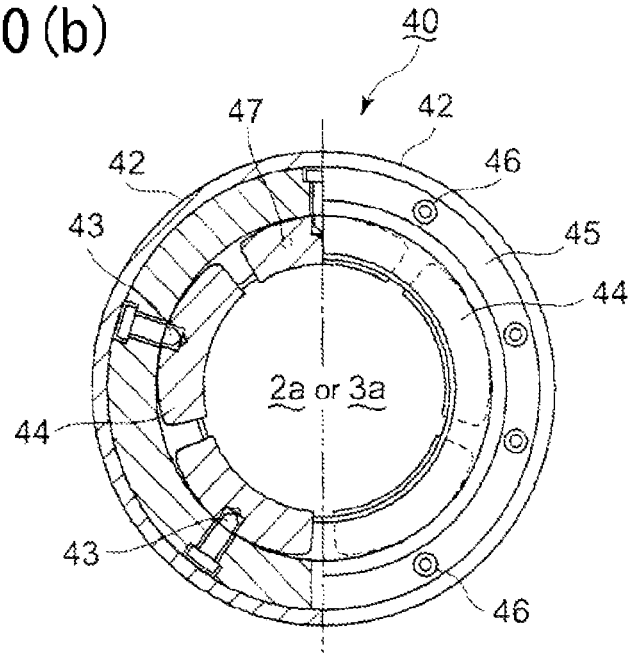

In the next place following the above described first embodiment, a second embodiment according to the present invention is now explained with reference to FIG. 10. In this second embodiment, a radial bearing 40 configured with tilting pads is applied as the radial bearing fitted to the rotor shaft 2*a* or 3*a* of the screw compressor having a lubricating oil system. As shown in FIG. 10, the radial bearing 40 includes, but not limited to:

- a bearing pedestal 41;
- a ring-shaped bearing housing 42 supported by the bearing pedestal 41;
- a plurality of tilting pads 44 that can tilt in the hoop direction as well as the axial direction regarding the rotor shaft 2*a* or 3*a* by the mechanism of a spherical pivot 43 connected to the bearing housing 42; and,
- two side plates 45 that are arranged on both sides (the gas charging side and the gas discharging side) of the tilting pads so as to constrain the movement of the tilting pads 44 in the rotor axis direction.

The side plates 45 are fastened to the bearing housing 42 by means of bolts 46. Incidentally, lube oil r is supplied to the clearance between the tilting pads 44 and the rotor shaft 2*a* or 3*a*, through an oil supplying hole (not shown), the clearance being filled with the lube oil r.

The tilting pad 44 is provided with a hole space 47 with the bottom, the hole space being bored in the vicinity of the bearing surface of the tilting pad; on the bearing surface of the tilting pad, the rotor shaft 2*a* or 3*a* rotates (via oil film). A penetrating hole 48 is bored at one of the side plates 45 so that the direction of the penetrating hole 48 agrees with the direction of the hole space 47 with the bottom and the position of the penetrating hole 48 corresponds to the opening of the hole space 47 with the bottom.

In this second embodiment, as is the case with the first embodiment, the temperature-detecting terminals 26 and the sheath tubes 27 are led to the penetrating hole 48 from the outside of the screw compressor having the lubricating system, through the penetrating hole (not shown) that is bored in the casing wall of the screw compressor as well as through the space s1 for inserting the radial bearing. Then, after the temperature-detecting terminals 26 and the sheath tubes 27 are passed through the penetrating hole 48, the temperature-detecting terminals 26 is inserted into and fixed in the hole space 47 with the bottom.

According to this embodiment, the temperature-detecting terminals 26 can be positioned in the vicinity of the bearing surface of the tilting pad 44, the outer periphery surface of the rotor shaft 2*a* or 3*a* sliding on and coming in contact with the bearing surface; thus, the temperature in a high temperature range of the vicinity of the bearing surface of the tilting pad 44 can be directly measured. Further, the temperature-detecting terminals 26 and the sheath tubes 27 are arranged so as to pass through the penetrating hole (not shown) that is bored in the casing wall of the screw compressor as well as through the space s1 for inserting the radial bearing; thus, the temperature-detecting terminals 26 and the sheath tubes 27 are easily laid in assembling the compressor. In addition, the detected temperature signals can be retrieved from the outside of the casing; and, the temperature-detecting terminals 26 can be easily attached to and detached from the temperature sensing part. In this way, the temperature monitoring as well as the temperature controlling regarding the bearing elements can be realized; the monitoring and controlling function during the screw compressor operation can be enhanced. Thus, the second embodiment as well as the first embodiment is useful and effective.

INDUSTRIAL APPLICABILITY

According to the present invention, the temperatures in the vicinity of the bearing surface of the radial bearing or the thrust bearing in the screw compressor having the lubricating oil system can be measured with accuracy, the bearing surface on the rotor shaft side sliding on and coming in contact with the bearing surface on the bearing side; further, the temperature-detecting terminals and the sheath tubes can be easily led to the temperature sensing locations. Thus, temperature monitoring as well as the temperature controlling regarding the bearing elements can be realized; the monitoring and controlling function during the screw compressor operation can be enhanced.

What is claimed is:

1. A screw compressor having a lubricating oil system, the compressor comprising:

a casing;

a rotor shaft; and at least one radial bearing and a plurality of thrust bearings, wherein the plurality of thrust bearings are attached to a casing wall of the casing at a position closer to an end side of the rotor shaft than the radial bearing, wherein the rotor shaft is supported rotation-freely by each bearing, wherein the radial bearing is provided with a flange part arranged on one end side of the radial bearing along an axial direction, the flange part having a diameter that is greater than a diameter of the rest of the radial bearing, wherein a hole space which has only one end opened, the open end being provided on a surface of the flange part and a temperature-detecting terminal is inserted through the open end in the radial bearing along an axis direction of the rotor shaft and a penetrating hole for communicating the hole space with an area outside of the casing is provided in the casing wall, wherein a sheath tube integrally formed with the temperature-detecting terminal is led into the hole space from the outside of the casing through the penetrating hole, and a temperature of the radial bearing detected at the temperature-detecting terminal is transferred to the area outside of the casing via a lead wire in the sheath tube, wherein the thrust bearings are mounted on the rotor shaft, wherein the rotor shaft on which the thrust bearings are fitted is smaller than the diameter of the rotor shaft where the radial bearing is mounted and that a step is provided between the smaller diameter part and the larger diameter part so that a sleeve configured with the thrust bearing is positionally fixed by contacting a front edge of the sleeve with the step, wherein the thrust bearing comprises a thrust member; the thrust member further comprising a disc; a pads-retaining member provided at each side of the disc; and a plurality of tilting pads are circumferentially provided in the space between the disc and the pads-retaining member, wherein the hole space having the open end is provided on one of the tilting pads so that the hole space is arranged in the radial direction parallel to a bearing surface of the tilting pad with regard to the disc, and the open end of the hole space is arranged toward a space for charging and discharging lube oil, the space being formed between the casing wall and the area where the thrust bearing is placed, and wherein the temperature-detecting terminal is guided radially and axially through a space located between an outer diameter of the radial bearing and an internal diameter of the casing.

2. The screw compressor having a lubricating oil system according to claim 1, wherein the radial bearing is a tilting pad journal bearing having a plurality of tilting pads which slide on and come in contact with an outer periphery of the rotor shaft, and wherein the hole space having the open end is provided in at least one of the tilting pads.

3. The screw compressor having a lubricating oil system according to claim 1, wherein the sheath tube is flexible regarding bending deformation.

4. The screw compressor having a lubricating oil system according to claim 1, wherein the penetrating hole is a lube oil charging and discharging hole.

* * * * *